US006286521B1

(12) United States Patent
Joulia

(10) Patent No.: US 6,286,521 B1
(45) Date of Patent: Sep. 11, 2001

(54) COSMETIC CASE

(75) Inventor: Gérard Joulia, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/503,851

(22) Filed: Feb. 15, 2000

(30) Foreign Application Priority Data

Feb. 16, 1999 (FR) ..... 99 01870

(51) Int. Cl.[7] ..... A45D 33/22
(52) U.S. Cl. ..... 132/295
(58) Field of Search ..... 132/293, 294, 132/297, 298, 300, 301, 313, 314, 315, 316, 317; 220/811, 812, 913; 206/823

(56) References Cited

U.S. PATENT DOCUMENTS

| | | | | |
|---|---|---|---|---|
| 391,145 | * | 10/1888 | Hardin | 220/815 |
| 1,488,282 | * | 3/1924 | Phillips | 132/294 |
| 1,613,536 | * | 1/1927 | Rose | 132/315 |
| 3,741,430 | | 6/1973 | Bergh et al. . | |
| 4,119,240 | * | 10/1978 | Dumas et al. | 220/812 |
| 4,420,079 | * | 12/1983 | Gliniorz et al. | 220/815 |
| 4,666,036 | | 5/1987 | Bourbon . | |
| 5,078,159 | * | 1/1992 | Yuhara | 132/295 |
| 5,353,947 | | 10/1994 | Zinnbauer et al. . | |
| 5,568,820 | * | 10/1996 | Dirksing | 132/315 |
| 5,638,839 | | 6/1997 | Montoli . | |
| 6,014,978 | * | 1/2000 | Yuhara | 132/293 |

FOREIGN PATENT DOCUMENTS 2 651 975 3/1991 (FR) .

OTHER PUBLICATIONS

English language Derwent Abstract of FR 2 651 975.

* cited by examiner

*Primary Examiner*—Jeffrey A. Smith
*Assistant Examiner*—Eduardo C. Robert
(74) *Attorney, Agent, or Firm*—Finnegan, Henderson, Farabow, Garrett & Dunner, L.L.P.

(57) ABSTRACT

The present application relates to a container configured as a cosmetic case and including a base and a lid capable of reversibly covering the base. The lid is mounted on the base in such a manner that, in the open position, it can be positioned under the base. According to the invention, the lid is mounted slidably with respect to a linking member, wherein the base and the linking member cooperate to guide sliding of the lid with respect to the linking member. The lid is also mounted pivotally with respect to the base, wherein the sliding movement of the lid is independent of the pivoting movement of the lid.

73 Claims, 4 Drawing Sheets

Figure 1:
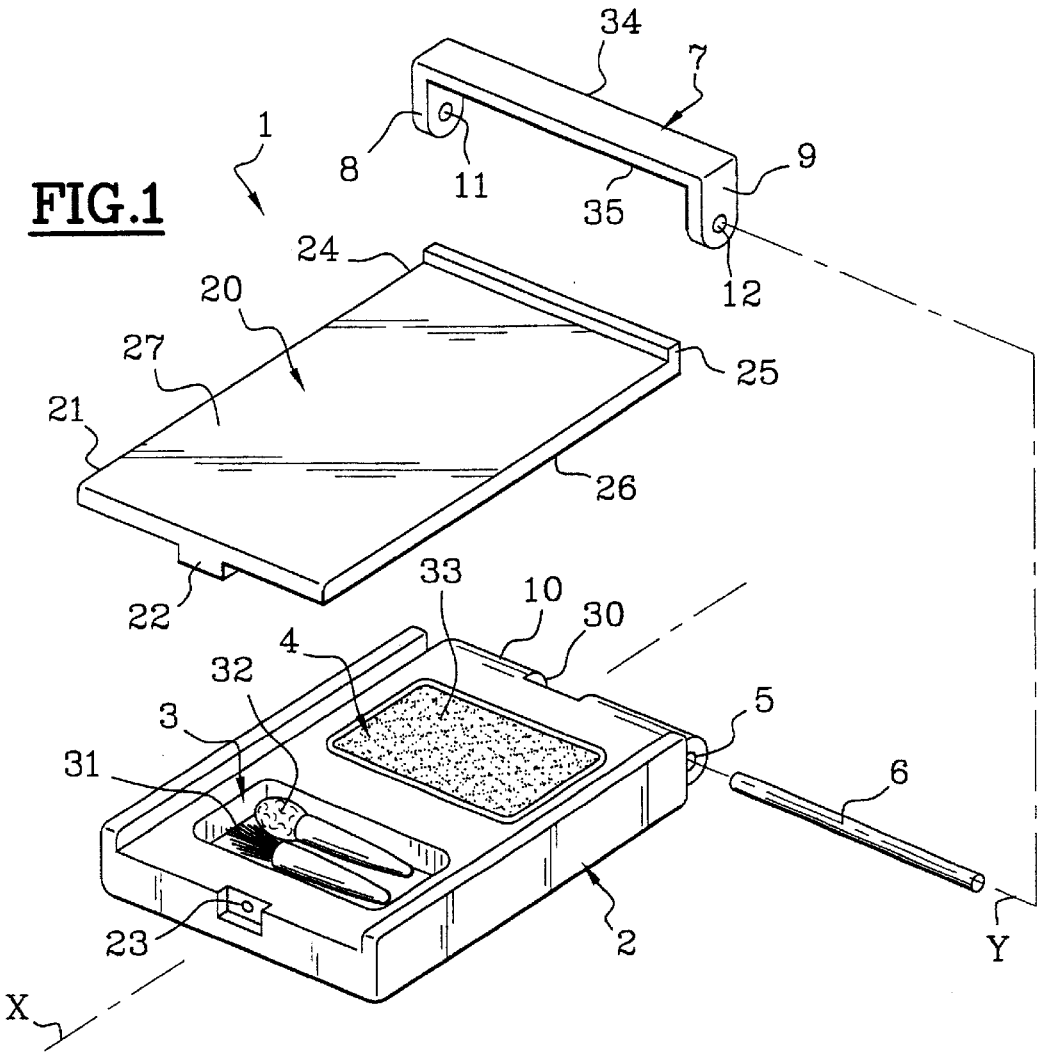

FIG.2B
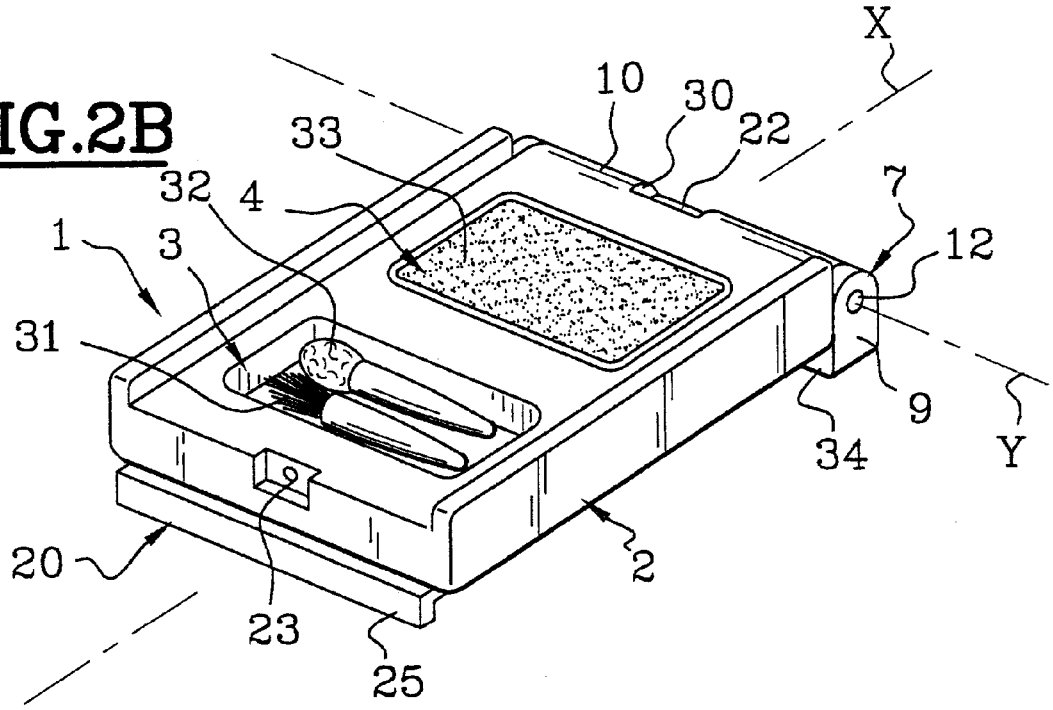
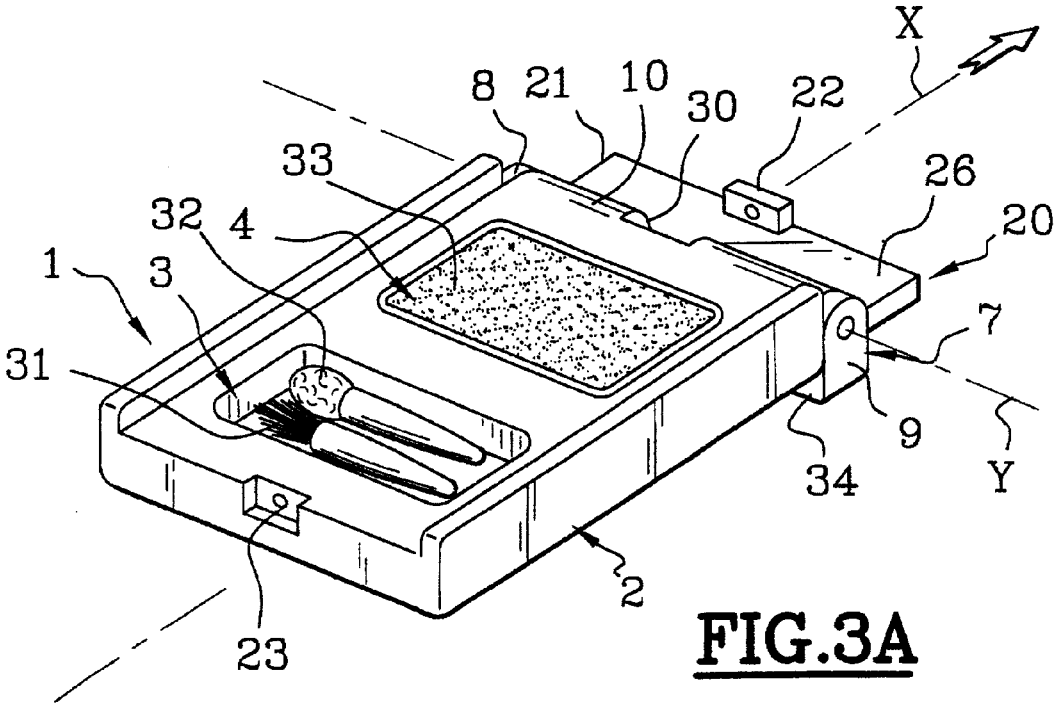
FIG.3A

COSMETIC CASE

The present invention relates to a container intended to be used particularly for the packaging of a cosmetic product in the form of a powder or of a compact. By way of example, a container of this type may be used for packaging a blusher, eyeshadow or rouge.

In the cosmetics industry, and more particularly in mass-marketing, make-up products are packaged in transparent blister packs suspended from a generally metal support. A vertical display unit containing an entire range of products allows the client to make her selection and purchase directly. However, it is sometimes difficult to make a choice owing to the large number of products on display.

It has been proposed to arrange such make-up products in cases of which at least a part, for example the lid, is transparent. Such a possibility is, however, not easily and cheaply applicable in the case of all products in a range. The presentation of the case with the lid open at 180° with respect to the base poses a problem of overall size.

From patent application FR-A-2 651 975, it is known to produce a case including a bottom and a cover. The cover is connected to a hinge piece by a first pin. The hinge piece is itself connected to the bottom by a second pin parallel to the first one. An arrangement of this type makes it possible, in the open position, to arrange the cover entirely under the bottom. Such a design nevertheless presents a major drawback linked, for example, to the complexity involved in assembling it, its fragility and its cost. Indeed, such a design requires the use of at least five separate pieces: a bottom, a cover, a hinge and two hinge pins.

U.S. Pat. No. 5,353,947 also describes a case of the type comprising a cover mounted directly on a base via a hinge pin. After having pivoted the cover with respect to the base, about the hinge pin, so as to orient the cover and the base at 180° with respect to each other, the cover is displaced under the base by sliding studs defining the hinge pin in corresponding slides formed in the cover. The presence of the slides in the cover requires the use of at least one more expensive mold for producing a case of this type. Moreover, handling of the case is more restricted.

It is thus one of the objects of the invention to produce a container of the type mentioned above which totally or partly solves the problems discussed with reference to conventional devices.

It is, in particular, an object of the invention to provide a container which makes it possible to position the lid under the base in the open position, and which is simple to produce, sturdy and inexpensive.

It should be understood that the invention could still be practiced without performing one or more of the preferred objects and/or advantages set forth above. Still other objects will become apparent after reading the following description of the invention.

To achieve these and other advantages, and in accordance with the purposes of the invention, as embodied and broadly described herein, the invention includes a container. According to the invention, the container includes a base and a lid capable of reversibly covering the base. The lid is preferably mounted on the base in such a manner that, in an open position, it can be positioned under the base. The lid is mounted slidably on a linking member pivotable about the base. Preferably, the linking member is pivoted about a rotational axis (Y) which is perpendicular to a longitudinal axis (X) of the container, and the lid is slidable with respect to the linking member along the longitudinal axis (X). According to an alternative embodiment, the linking member may be articulated about a rotational axis parallel to the longitudinal axis (X), and the lid is slidable with respect to the linking member along an axis parallel to the longitudinal axis (X).

Thus, a preferred container of this type may be produced as four components, namely: a base, a lid, a hinge pin and a linking member. Its operation, both in opening and in closing, is preferably simple. A container of this type is preferably sturdy, and inexpensive to produce. With a configuration according to the invention, it is possible to use the linking member as the member for guiding the lid as the lid slides under the base, which makes it possible to facilitate handling, both on opening and on closing. Moreover, when the container is obtained by molding, the molds required for producing it are preferably simpler and therefore less expensive.

The mounting of the lid on the base via a linking member which is pivoted with respect to the base makes it possible to separate the pivot movement of the lid with respect to the base from the axial sliding movement of the lid under the base. Preferably, handling is substantially improved.

According to the invention, in any non-locked position of the lid with respect to the base, it is possible to pivot the lid with respect to the base irrespective of the axial position of the lid with respect to the base.

According to an advantageous embodiment, the lid includes a first face, called the inner face, intended to come opposite the base in the closed position of the lid, and a second outer face opposite the first inner face, the lid being mounted so that, when it is positioned under the base, the first face is opposite the base. This characteristic is particularly advantageous in that, when a mirror is arranged on the inner face of the lid or when the inner face of the lid is a reflective surface forming a mirror, the lid is protected against any risk of damage during its storage.

More specifically, the linking member may be formed from a U-shaped component pivoted on the base about a rotational axis passing through the two free ends of the legs of the U, the lid being mounted so as to slide between the rotational axis and the base of the U. Thus, during the movement for positioning the lid under the base, the lid may be displaced parallel to its plane until it reaches its final position under the container. At the time of this movement, it is preferably guided partly by the base of the container and partly by the U-shaped linking member.

Advantageously, stopping members are provided in order to limit the sliding of the lid with respect to the linking member between a first, open position in which the lid is arranged substantially entirely under the base and a second position, called the pivoting position, in which the lid at least partially covers the base and is offset with respect to the base so as to be able to be rocked in the closure position of the container. A snap-fit connecting element may be provided to reversibly lock the lid in the first and second positions.

More advantageously, at a first end of the lid, the stopping members include an element capable of reversibly locking the lid on the base. Typically, such a locking member includes a tab extending substantially in a plane perpendicular to a plane of the container and intended to interact by elastic deformation or by snap-fitting with a corresponding member provided on the base of the container. At the other end of the lid, it is also possible to provide a tab folded through 90° with respect to the plane of the lid. Thus, the closure forms a stop in the position in which the lid is under the container, whilst the other tab forms a stop in the pivoting position of the base with respect to the lid.

Preferably, the base includes at least a first compartment configured to receive a product, particularly a cosmetic product. More preferably, the container also includes a second compartment configured to receive an application member for the cosmetic product, for example a powder-puff, a pencil brush or a brush. The face of the container intended to come opposite the base may include a mirror or a reflective surface to act as a mirror.

A container of this type may be used for packaging a make-up product, particularly a blusher, rouge, eyeshadow or a foundation.

According to one aspect of the present invention, a container is provided. The container includes a base, a lid pivotally mounted on the base, the lid being moveable between a first position at least partially covering the base and a second position below the base, and a linking member connected to the base, wherein the lid is slidable with respect to the linking member, and wherein the linking member and the base cooperate to guide sliding of the lid with respect to the linking member.

According to another aspect of the invention, pivoting motion of the lid with respect to the base is independent of the sliding motion of the lid with respect to the linking member.

According to yet another aspect of the present invention, the linking member maintains the lid portion slidably between the base portion and the linking member.

According to one other aspect of the invention, the cosmetic case includes a base having at least one compartment, and a cosmetic applicator is contained in the at least one compartment.

According to a further aspect of the invention, a cosmetic product is contained in the at least one compartment on the base.

According to yet another aspect of the invention, the lid is substantially planar.

According to another aspect of the invention, the linking member is substantially U-shaped and the lid pivots about an axis of rotation passing through an end of the base and through legs of the U-shaped linking member.

According to an even further aspect of the invention, a method of accessing a product in a container is provided. The method includes providing the container with the lid in the first position, rotating the lid and the linking member with respect to the base, and sliding the lid with respect to the linking member and base to position the lid in the second position, wherein the linking member and the base guide sliding movement of the lid.

Beside the structural arrangements set forth above, the invention could include a number of other arrangements, such as those explained hereinafter. It is to be understood that both the foregoing description and the following description are exemplary, and are intended to provide further explanation of the invention as claimed.

Figure 2A:
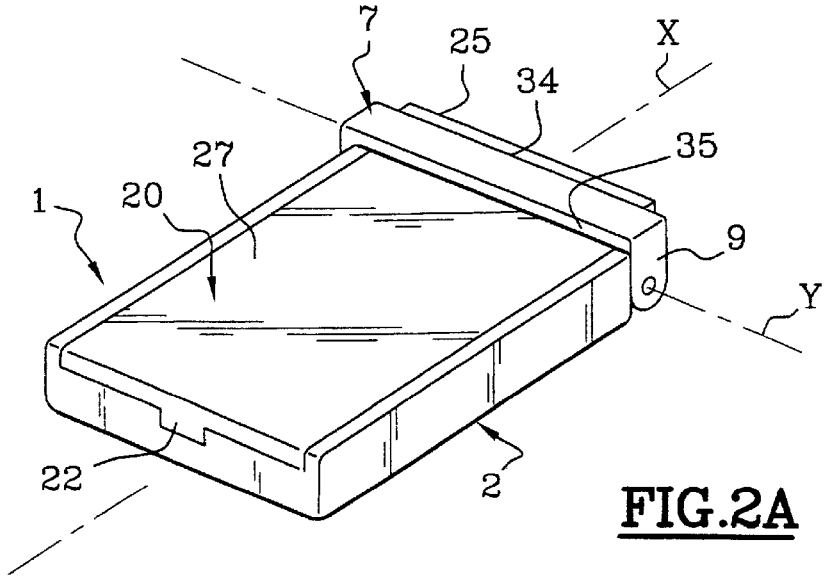

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is an exploded view of an embodiment of the container according to the invention;

FIGS. 2A–2B are perspective views of the container of FIG. 1 in the closed position and the container of FIG. 1 in the open position, respectively; and FIGS. 3A–3E are isometric views of different stages in the process of closing the container shown in FIGS. 1 and 2A–2B.

Reference will now be made in detail to the present preferred embodiments of the invention, examples of which are illustrated in the accompanying drawings. Wherever possible, the same reference numbers are used in the drawings and the description to refer to the same or like parts.

As embodied herein and shown in FIG. 1, the container 1 includes a base 2 having a longitudinal axis (X). The base 2 includes one or more compartments 3, 4 which will be discussed in greater detail below with reference to FIG. 2B. A first end of the base ends in a portion 10 of substantially circular cross section. Base end portion 10 includes an orifice 5 (or a number of orifices arranged opposite one another) perpendicular to the longitudinal axis (X). The orifice(s) 5 are intended to receive a rod 6 capable of defining a hinge pin to permit rotation of a linking member 7 with respect to the base about a rotational axis (Y) perpendicular to the longitudinal axis (X). The linking member 7 is preferably a substantially U-shaped element. Other suitably shaped and sized linking members may be used. Passing through the two legs 8, 9 of the linking member 7 in the vicinity of its free ends are orifices 11, 12 capable of being placed opposite the orifice(s) 5 of the base 2, so as to allow pivotable mounting of the linking member 7 on the base 2 via the rod 6. A recess 30 is provided in the base portion 10 so as to form a housing for a member capable of being placed inside the recess 30. This feature will be described in greater detail below.

Between the base 2 and the base wall 35 of the U-shaped linking member 7, container 1 includes a substantially planar lid 20 with a width similar to the width of the base 2 so as, in the closed position, to cover all (or at least a portion) of the base 2 and to delimit, together with the base 2, a closed volume. Lid 20 is mounted to slide between the base 2 and the linking member 7. Lid 20 is also mounted to pivot with respect to base 2. The sliding motion of the lid 20 is preferably independent of the pivoting motion of the lid. At an end 21 opposite the rotational axis (Y), the lid includes a closure 22 configured to interact, by snap-fitting, with a complementary portion 23 of the base 2, so as reversibly to lock the lid 20 on the base 2. The closure 22 preferably includes a tab extending in the direction of the base 2, substantially at 90° with respect to the plane of the lid 20. The closure 22 also acts as a stopping member, as will be discussed in detail below, to limit the sliding movement of the lid 20 under the base 2.

At an end 24 of lid 20 opposite the end 21 carrying the closure 22, the lid 20 carries an angled portion 25 of the lid 20 angled away from the base, at approximately 90° with respect to the plane of the lid 20. The angled portion 25 is oriented in an opposite manner from the tab 22 forming the closure. As will be seen in greater detail below, the angled portion 25 acts as a stopping member, making it possible, in the position where the lid is on the base, to limit the sliding movement of the lid 20 when the lid 20 is withdrawn from its position located under the base 2 with a view to closing the container, and thus acts to prevent the lid 20 from becoming detached from the base 2. In a preferred embodiment, the container is produced from polypropylene or from ABS. The lid 20 may be produced from any other suitable plastic or metal material. The lid 20 has two faces 26, 27: an inner face 26 located opposite the base and an outer face 27 located opposite the face 26 and located outside the container when the container is closed. Inner face 26 of lid 20 is preferably a reflective surface which may serve as a mirror surface. In an alternative embodiment, inner face 26 of lid 20 may have a mirror attached thereto. Lid 20 is mounted to the container 1 in such a manner that inner face 26 of lid 20 always faces the base 2 when the lid is positioned in its closed position above the base 2 and when the lid 20 is positioned in the open position under the base 2. This serves to protect the reflective inner face of lid 20.

In FIG. 2A, the container 1 is shown in the closed position, with the lid 20 delimiting, together with the base 2, a closed volume, the closure 22 being in elastic engagement with the corresponding member 23 of the base. The outer face 27 of the lid 20 is outside the container 1. The angled portion 25 of the lid 20 abuts against an edge 34 of the base wall 35 of the U-shaped linking member 7.

In FIG. 2B, the lid 20 is arranged under the base 2 of the container. The closure 22 abuts against the portion 10 of circular cross section of the base, inside the recess 30 discussed hereinabove with reference to FIG. 1. The angled portion 25 of the lid is substantially in alignment with the end of the base carrying the closure member 23.

In a most preferred embodiment, the container 1 is a cosmetic case. In the compartment 3 of the base there preferably are a first applicator 31 in the form of a slender brush, and a second applicator 32 in the form of a block of foam. In an alternative embodiment, only one applicator or applicators of different types may be present in the compartment 3. In the compartment 4 there is preferably a cake of eyeshadow 33. In an alternative embodiment, there may be two compartments containing similar types of cosmetic products or the compartment 4 may contain a different type of cosmetic product. The container may be packaged in a transparent blister pack. The contents of the container are fully visible from the outside. Preferably, the overall size of the container is reduced on account of the position of the lid 20 under the base.

Figure 3B:
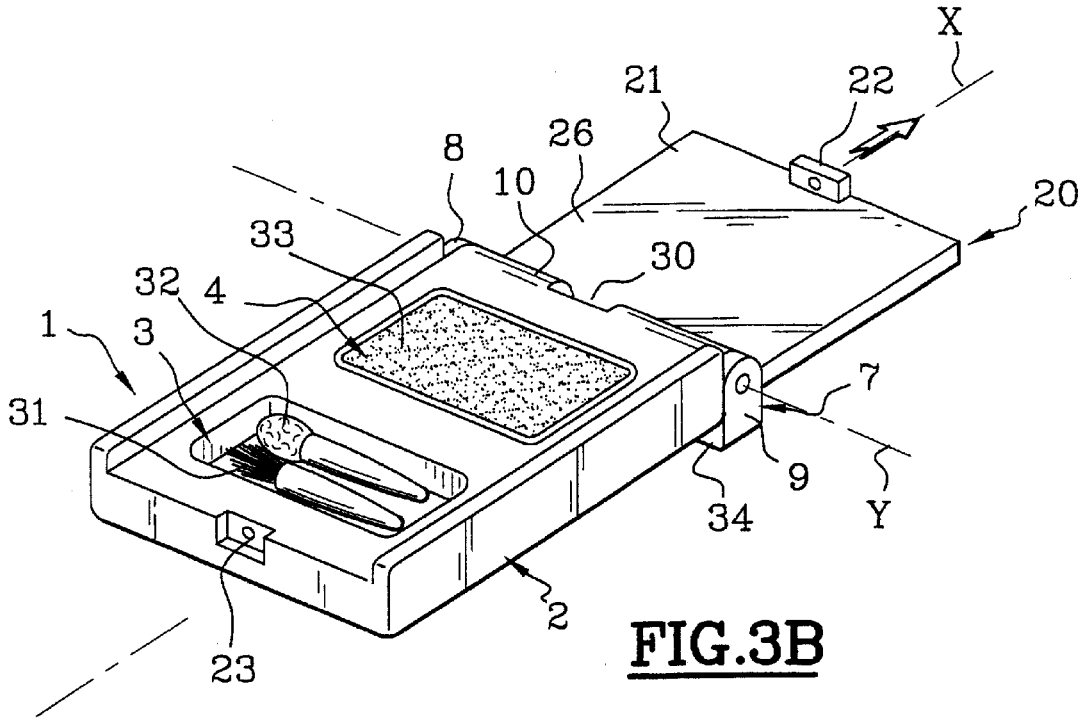
Figure 3C:
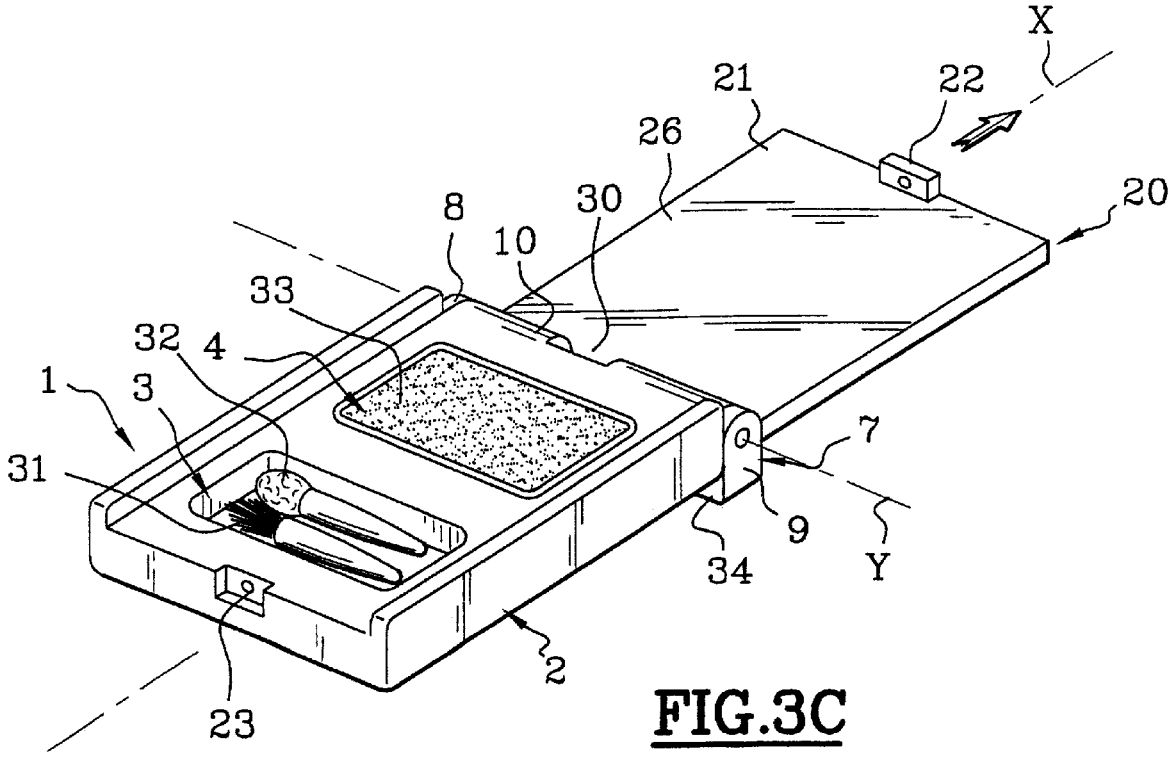
Figure 3D:
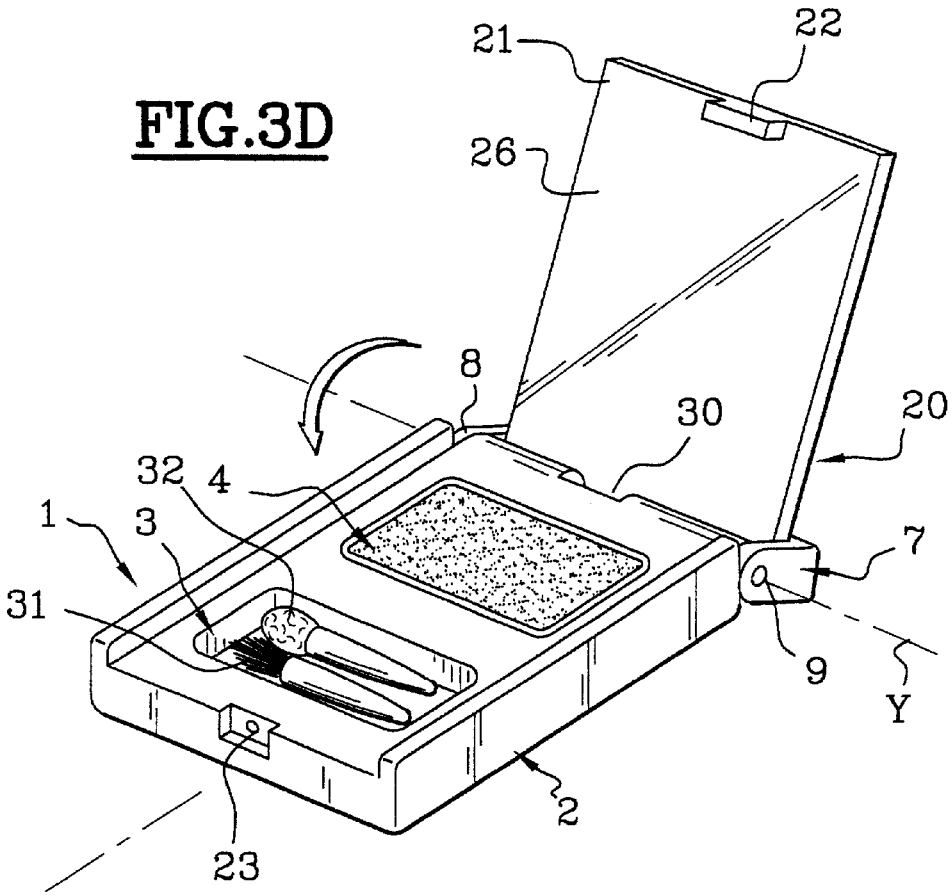
Figure 3E:
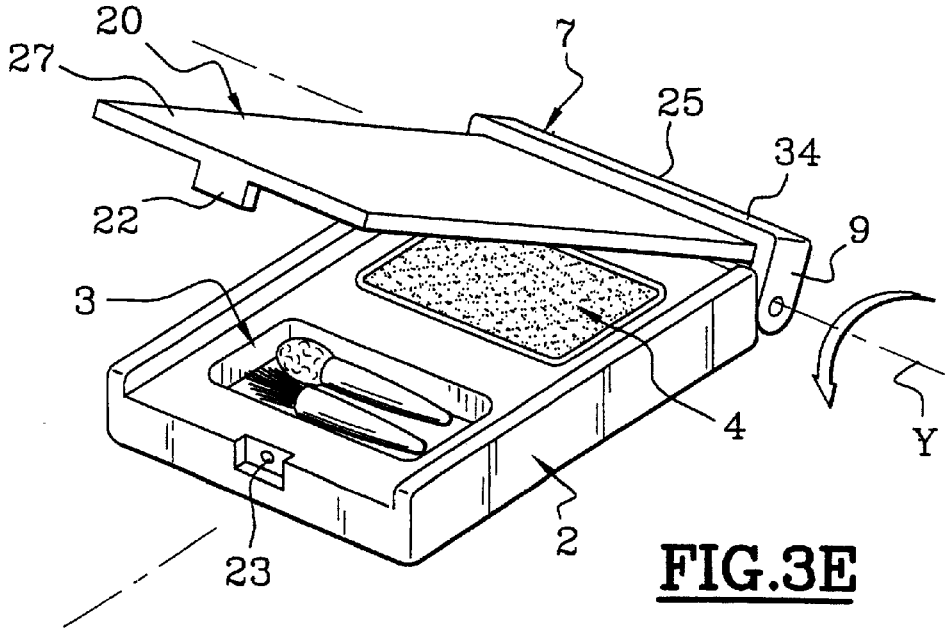

Starting from the position shown in FIG. 2B, the user pulls the lid 20 using the tab of the closure 22 as gripping means (see FIG. 3A). The lid 20 slides between the base 2 and the linking member 7 with a movement in a plane substantially parallel to the plane of the container 1. The movement continues in the manner shown in FIG. 3B until the angled portion 25 of the lid abuts against the corresponding edge 34 of the base of the U-shaped linking member 7 (see FIG. 3C) and reaches the so-called pivoting position. Snap-fitting means (not shown) can provide reversible locking of the lid in this position. At this time, the user can pivot the lid 20 and the linking member 7 with respect to the base 2 about the rotational axis (Y). It then remains to press the lid 20 gently so as to place the closure 22 of the lid in elastic engagement with the corresponding element 23 of the base 2.

Upon opening the container 1, the procedure is reversed. The user pivots the lid 20 and the linking member 7 with respect to the base 2 about the rotational axis (Y) and does so until the lid is substantially positioned at 180° with respect to the base. She then pushes the lid 20 under the base 2 until the closure 22 abuts in the recess 30 of the base portion 10 of the base 2. Snap-fitting means (not shown) may provide reversible locking of the lid in this position.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. A container comprising:

a base;

a lid pivotally mounted on the base, the lid being moveable between a first position at least partially covering the base and a second position below the base; and a linking member connected to the base;

wherein the lid is slidable with respect to the linking member, and wherein the linking member and the base cooperate to guide sliding of the lid between the base and the linking member.

2. The container of claim 1, wherein the lid slides with respect to the base and the linking member when the lid moves to the second position below the base.

3. The container of claim 1, wherein the lid is slidable along a longitudinal axis of the container, and wherein the linking member is pivotally connected to said base such that said linking member is pivotable about an axis perpendicular to the longitudinal axis of the container.

4. The container of claim 1, wherein the lid includes inner and outer faces, and wherein the inner face of the lid faces the base when the lid is positioned in the first and second positions.

5. The container of claim 1, wherein the lid includes stopping members for limiting movement of the lid between a position in which the lid is substantially entirely under the base and a position in which the lid is offset from the base.

6. The container of claim 5, wherein the stopping members are configured to limit sliding of the lid.

7. The container of claim 1, wherein the base includes at least one compartment configured to receive a make-up product.

8. The container of claim 1, wherein the base includes a first compartment configured to receive a cosmetic product and a second compartment configured to receive an applicator member for the cosmetic product.

9. The container of claim 1, wherein the base includes a compartment containing at least one of a foundation, a blusher, a rouge, and an eyeshadow product.

10. The container of claim 1, wherein the linking member is pivotable about an axis of rotation, and wherein the linking member is connected to the base member along the axis of rotation.

11. The container of claim 1, wherein the base includes an area for receiving a locking member of the lid.

12. The container of claim 1, wherein an inner face of the lid includes a mirror.

13. The container of claim 1, wherein the lid is substantially planar.

14. The container of claim 1, wherein said lid is pivotable and slidable with respect to said base, and wherein the sliding motion of the lid with respect to the base is independent of the pivoting motion of the lid with respect to the base.

15. A method of accessing a product in a container, comprising:

providing the device of claim 1 having the lid in the first position, rotating the lid and the linking member with respect to the base; and sliding the lid with respect to the linking member and base to position the lid in the second position, wherein the linking member and the base guide sliding movement of the lid.

16. The container of claim 1, wherein the linking member is movable with respect to the base.

17. A container comprising:

a base;

a lid pivotally mounted on the base, the lid being moveable between a first position at least partially covering the base and a second position below the base; and a linking member connected to the base, wherein the linking member is substantially U-shaped and pivotally connected to the base such that the linking member is pivotable about a rotational axis passing through legs of the U-shaped linking member, wherein the lid is slidable with respect to the linking member and is mounted to slide between said rotational axis and a base of the U-shaped linking member, and wherein the linking member and the base cooperate to guide sliding of the lid with respect to the linking member.

18. A container comprising:

a base;

a lid pivotally mounted on the base, the lid being moveable between a first position at least partially covering the base and a second position below the base; and a linking member connected to the base;

wherein the lid is slidable with respect to the linking member, and wherein the linking member and the base cooperate to guide sliding of the lid with respect to the linking member, wherein the lid includes at least one stopping member for limiting movement of the lid with respect to the linking member, and wherein said at least one stopping member is a locking member configured to reversibly lock the lid on the base.

19. A container comprising:

a base;

a linking member connected to the base, wherein the linking member is substantially U-shaped; and a lid pivotally mounted on the base, the lid including inner and outer faces and being moveable between a first position at least partially covering the base and a second position below the base, wherein the outer face of the lid faces a base of the U-shaped linking member when the lid is in the first and second positions, wherein the lid is slidable with respect to the linking member, and wherein the linking member and the base cooperate to guide sliding of the lid with respect to the linking member.

20. The container of claim 19, wherein the lid is mounted to slide between the base of the container and the base of the U-shaped linking member.

21. A container comprising:

a base;

a lid pivotally mounted on the base, said lid being moveable between a first position at least partially covering the base and a second position below the base; and a linking member connected to said base, said lid being slidable with respect to the linking member and said linking member being movable with respect to said base, wherein pivoting motion of the lid with respect to the base is independent of the sliding motion of the lid with respect to the linking member.

22. The container of claim 21, wherein the lid is substantially planar.

23. The container of claim 21, wherein the lid includes a mirror.

24. The container of claim 21, wherein the base includes a compartment configured to contain a product.

25. The container of claim 21, wherein the base includes two compartments.

26. The container of claim 21, wherein the linking member is substantially U-shaped, and wherein the linking member is pivotable about an axis of rotation passing through an end portion of the base and through legs of the U-shaped linking member.

27. The container of claim 21, wherein the lid is mounted between the linking member and the base.

28. The container of claim 21, wherein the lid includes inner and outer faces, and wherein the inner face of the lid faces the base when the lid is positioned in the first and second positions.

29. A method of accessing a product in a container, comprising:

providing the device of claim 21 having the lid in the first position;

rotating the lid and the linking member with respect to the base; and sliding the lid to position the lid in the second position, wherein the rotating and the sliding are independent of one another.

30. A container for a product, comprising:

a base portion including at least one compartment for containing a product;

a lid portion configured to at least partially cover the base portion; and a linking member connected to said base portion, said linking member maintaining said lid portion slidably between said base portion and said linking member.

31. The container of claim 30, wherein the linking member is connected to an end of the base portion, and wherein the linking member is pivotable about an axis of rotation extending through said end of the base portion.

32. The container of claim 30, wherein the lid portion is moveable between a closed position above the base portion and an open position below the base portion.

33. The container of claim 32, wherein the lid portion includes inner and outer faces, and wherein the inner face of the lid portion is in contact with the base portion in the open position and in the closed position.

34. The container of claim 33, wherein the linking member is substantially U-shaped, and wherein the outer face of the lid portion faces a base of the U-shaped linking member when the lid portion is in the open and closed positions.

35. The container of claim 30, wherein the lid portion includes a mirror.

36. The container of claim 30, wherein the lid portion is substantially planar.

37. The container of claim 30, wherein the lid portion is pivotally and slidably mounted with respect to the base portion.

38. The container of claim 37, wherein the sliding motion of the lid portion with respect to the base portion is independent of the pivoting motion of the lid portion with respect to the base portion.

39. The container of claim 30, wherein the base portion and the linking member cooperate to slidably guide the lid portion between the base portion and the linking member.

40. The container of claim 30, wherein the lid portion includes a locking member for locking the lid portion to the base portion.

41. The container of claim 40, wherein the base portion includes an area for receiving the locking member.

42. The container of claim 40, wherein the base portion includes a first area for receiving the locking member when the lid portion is in a closed position above the base portion, and a second area for receiving the locking member when the lid portion is in an open position below the base portion.

43. The container of claim 30, wherein the base portion includes at least one compartment configured to contain a cosmetic product.

44. The container of claim 30, wherein the container is a cosmetic case.

45. The container of claim 30, wherein the linking member is movable with respect to the base.

46. A container comprising:

a base;

a substantially planar lid slidably mounted on the base, said lid being configured such that the lid does not extend over sides of said base, said lid being moveable between a first position at least partially covering the base and a second position below the base; and a linking member connected to said base, said linking member guiding the sliding of the lid with respect to said base.

47. The container of claim 46, wherein the lid is slidably mounted between the linking member and the base.

48. The container of claim 46, wherein the base and linking member cooperate to slidably guide the lid between the base and linking member.

49. The container of claim 46, wherein the lid includes a mirror.

50. The container of claim 46, wherein the base includes a compartment containing a cosmetic product.

51. The container of claim 46, wherein the base includes a compartment containing a cosmetic applicator.

52. The container of claim 46, wherein the linking member is substantially U-shaped and pivotally connected to the base such that the linking member is pivotable about an axis of rotation passing through an end portion of the base and through legs of the U-shaped linking member.

53. The container of claim 46, wherein the linking member is movable with respect to the base.

54. A container comprising:

a base portion including at least two compartments, wherein one of the compartments contains a cosmetic product and the other of the compartments contains an applicator for the cosmetic product;

a lid portion configured to at least partially cover the base portion; and a linking member connected to said base portion, said linking member maintaining said lid portion slidably between said base portion and said linking member.

55. A container comprising:

a base including a compartment containing a cosmetic product;

a lid pivotally mounted on the base, said lid being moveable between a first position at least partially covering the base and a second position below the base; and a linking member connected to said base, said lid being slidable with respect to the linking member and said linking member being movable with respect to said base, wherein pivoting motion of the lid with respect to the base is independent of the sliding motion of the lid with respect to the linking member.

56. A container comprising:

a base including a compartment containing a cosmetic applicator;

a lid pivotally mounted on the base, said lid being moveable between a first position at least partially covering the base and a second position below the base; and a linking member connected to said base, said lid being slidable with respect to the linking member and said linking member being movable with respect to said base, wherein pivoting motion of the lid with respect to the base is independent of the sliding motion of the lid with respect to the linking member.

57. A cosmetic case comprising:

a base having at least one compartment;

a cosmetic product contained in the at least one compartment;

a lid slidably mounted on the base, said lid being moveable between a first position at least partially covering the base and a second position below the base; and a linking member connected to said base, said linking member being movable with respect to said base and guiding the sliding of the lid with respect to said base.

58. The cosmetic case of claim 57, wherein the lid includes a mirror.

59. The cosmetic case of claim 57, wherein the lid is pivotable with respect to the base.

60. The cosmetic case of claim 57, wherein the base includes a second compartment.

61. The cosmetic case of claim 57, wherein the linking member is substantially U-shaped, and wherein the linking member is pivotable about an axis of rotation passing through an end portion of the base and through legs of the U-shaped linking member.

62. A cosmetic case comprising:

a base having at least one compartment;

a cosmetic product contained in the at least one compartment;

a lid slidably mounted on the base, said lid being moveable between a first position at least partially covering the base and a second position below the base; and a linking member connected to said base, said linking member guiding the sliding of the lid with respect to said base, wherein the lid is slidably mounted between the linking member and the base.

63. A cosmetic case comprising:

a base having at least one compartment;

a cosmetic applicator contained in the at least one compartment;

a lid slidably mounted on the base, said lid being movable between a first position at least partially covering the base and a second position below the base; and a linking member connected to said base, said linking member being movable with respect to said base and guiding the sliding movement of the lid with respect to said base.

64. The cosmetic case of claim 63, wherein the lid includes a mirror.

65. The cosmetic case of claim 63, wherein the lid is pivotable with respect to the base.

66. The cosmetic case of claim 63, wherein the base further includes a second compartment.

67. A cosmetic case comprising:

a base having at least one compartment;

a cosmetic applicator contained in the at least one compartment;

a lid slidably mounted on the base, said lid being movable between a first position at least partially covering the base and a second position below the base; and a linking member connected to said base, said linking member guiding the sliding movement of the lid with respect to said base, wherein the lid is slidably mounted between the linking member and the base.

68. A cosmetic case comprising:

a base having at least one compartment;

a cosmetic applicator contained in the at least one compartment;

a lid slidably mounted on the base, said lid being movable between a first position at least partially covering the base and a second position below the base; and a linking member connected to said base, said linking member guiding the sliding movement of the lid with respect to said base, wherein the linking member is substantially U-shaped, and wherein the linking member is pivotable about an axis of rotation passing through an end portion of the base and through legs of the U-shaped linking member.

69. A container comprising:

a base;

a lid pivotally mounted on the base, the lid being moveable between a first position at least partially covering the base and a second position below the base; and a substantially U-shaped linking member guiding sliding movement of the lid with respect to said base, wherein the lid pivots about an axis of rotation passing through an end of the base and through legs of the U-shaped linking member, wherein the lid is mounted to slide between said rotational axis and a base of the U-shaped linking member.

70. The container of claim 69, wherein the linking member is movable with respect to the base.

71. A container for a product, comprising:

a base portion including at least one compartment for containing a product;

a lid portion configured to at least partially cover the base portion, the lid portion being moveable between an open position and a closed position; and a linking member connected to said base portion, said linking member maintaining said lid portion slidably between said base portion and said linking member, wherein the linking member is substantially U-shaped, and wherein an outer face of the lid portion faces a base of the U-shaped linking member when the lid portion is in the open and closed positions.

72. A container for a product, comprising:

a base portion including at least one compartment for containing a product;

a lid portion configured to at least partially cover the base portion; and a linking member connected to said base portion, said linking member maintaining said lid portion slidably between said base portion and said linking member, wherein an outer face of the lid is between the linking member and the base.

73. A container for a product, comprising:

a base portion including at least one compartment for containing a product;

a lid portion configured to at least partially cover the base portion; and a linking member connected to said base portion, said linking member maintaining said lid portion slidably between said base portion and said linking member, wherein an outer face of the lid contacts the linking member during lid sliding.

* * * * *